US006003282A

United States Patent [19]

Alderman et al.

[11] Patent Number: 6,003,282

[45] Date of Patent: Dec. 21, 1999

[54] MOVABLE SAFETY BARRIER FOR CONSTRUCTION OF A ROOF STRUCTURE

[75] Inventors: Robert J. Alderman, Canyon Lake; James E. Taylor, Seguin, both of Tex.

[73] Assignee: Owens Corning Fiberglas Technology, Inx., Summit, Ill.

[21] Appl. No.: 09/016,034

[22] Filed: Jan. 30, 1998

[51] Int. Cl.[6] ..... E04D 1/34

[52] U.S. Cl. ..... 52/749.12; 52/273; 52/163; 52/745.12; 52/745.13; 248/237; 248/148; 221/131; 221/123; 160/391; 160/392

[58] Field of Search ..... 52/745.13, 749.12, 52/746.11, 746.1, 745.06, 742.12, 273, 163; 221/131, 123; 248/237, 148; 160/391, 392, 395

[56] References Cited

U.S. PATENT DOCUMENTS

| | | | |
|---|---|---|---|
| 3,851,848 | 12/1974 | Wiele | 248/273 |
| 3,969,863 | 7/1976 | Alderman | 52/746.11 |
| 4,047,346 | 9/1977 | Alderman . | |
| 4,068,446 | 1/1978 | Brueske . | |
| 4,075,807 | 2/1978 | Alderman | 52/746.11 |
| 4,337,815 | 7/1982 | Lindstrom | 160/392 |
| 4,375,741 | 3/1983 | Paliwoda . | |
| 4,434,601 | 3/1984 | Zellmer . | |
| 4,446,664 | 5/1984 | Harkins . | |
| 4,557,092 | 12/1985 | Brueske . | |
| 4,566,239 | 1/1986 | Smigel et al. . | |
| 4,967,535 | 11/1990 | Alderman . | |
| 5,251,415 | 10/1993 | Van Auken et al. . | |
| 5,491,952 | 2/1996 | Alderman et al. | 52/749.12 |
| 5,495,698 | 3/1996 | Alderman et al. | 52/745.06 |
| 5,551,203 | 9/1996 | Alderman et al. | 52/746.11 |
| 5,653,081 | 8/1997 | Wenrick et al. | 52/742.12 |
| 5,653,083 | 8/1997 | Alderman | 52/746.11 |
| 5,664,740 | 9/1997 | Alderman et al. . | |
| 5,685,123 | 11/1997 | Alderman et al. | 52/746.11 |
| 5,720,147 | 2/1998 | Wenrick et al. | 52/746.11 |
| 5,749,195 | 5/1998 | Laventure | 52/746.1 |

*Primary Examiner*—Carl D. Friedman
*Assistant Examiner*—Phi Dieu Tran A
*Attorney, Agent, or Firm*—Inger H. Eckert; Stephen W. Barns

[57] ABSTRACT

A movable safety barrier for use in constructing a roof structure having purlins spaced apart from one another in a parallel arrangement is disclosed. The barrier extends laterally across a plurality of the purlins. The barrier is mounted for movement along the length of the purlins as the roof structure is constructed. The barrier includes a plurality of runner portions positioned above the purlins. The barrier further includes a plurality of support portions extending between adjacent runner portions.

14 Claims, 5 Drawing Sheets

MOVABLE SAFETY BARRIER FOR CONSTRUCTION OF A ROOF STRUCTURE

TECHNICAL FIELD AND INDUSTRIAL APPLICABILITY OF THE INVENTION

This invention relates to the construction of an insulated metal roof structure for use in commercial and industrial buildings.

BACKGROUND OF THE INVENTION

Buildings having metal roof structures typically comprise a series of parallel rafter beams which are supported by vertical columns extending from the floor of the building. A plurality of spaced apart purlin beams extend in a direction normal to the rafter beams and are fastened to top portions of the rafter beams. Typically, the roofs generally have two sloped sections, each extending from a side of the building to a peak. To enclose the roof structure, sheets of hard roofing material, such as metal deck sheets can be used to cover the roof structure. The deck sheets are typically interlaced and fastened to the purlins.

Ordinarily, the roof structures include some type of insulation material placed above or below the deck sheets to provide thermal insulation for the building. In one type of insulated roof structure, insulation material in long sheets is placed in the area between purlins. The sheets of insulation material can be laid along the length of the purlins or across the purlins in a direction normal to the purlins. The insulation material is supported between the purlins beneath the hard roofing material. Various methods of supporting the insulation material have been used. Mounting straps or wire mesh which are attached to or draped over the purlins forming a lattice have been used. A sheet, typically made of vinyl and acting as a vapor barrier, is then rolled onto the lattice, and insulation material is placed between adjacent purlins and over the sheet. Some systems dispense with the lattice and use the sheet itself to support the insulation material. The support sheet is dispensed from a roll and draped from adjacent purlins. Insulation material is then placed on top of the support sheet. A carriage has been used to aid in the dispensing of the support sheet, such as that disclosed in U.S. Pat. No. 4,967,535 to Alderman. The carriage is positioned on top of the purlins and travels the length of the purlins during the roof construction. A roll of the support sheet material is mounted on the carriage and the support sheet is dispensed from the roll and placed on top of the purlins. As the carriage travels the length of the purlins, the support sheet is draped across the purlins.

In another type of insulated roof structure, insulation material, such as rigid insulation board, is placed on top of metal deck sheets. The insulated board and the deck sheets are then fastened to the top portions of the purlins. A water proof membrane is then applied on top of the insulation board, to provide a weather tight seal.

It is customary to construct the roof along the length of the structure from one end to the other. The workers stand on the previously completed section of roof to construct the next section. Because the metal deck sheets typically comes in long sheets and the roofs generally have two sloped sections, it is customary to construct the roof along the length of the structure from one end to the other.

Of considerable importance to the construction of roof structures, is the safety of the workers. In the past, permanent netting has been provided under the workers on top of the roof structure to help prevent the workers from falling and from being hit by dropped objects, such as tools and bolts. U.S. Pat. No. 5,251,415 to Van Auken et al. discloses such a netting. Prior to construction of the roof, the netting is placed over the tops of the purlins. The netting spans the entire roof and can be placed in a loose manner to support insulation material placed on top to provide space for the insulation material. When the insulation material and the deck sheets are installed above the netting, the netting becomes a permanent structure of the roof. Although the use of this netting has been satisfactory, it can be difficult and time consuming to install the netting across the entire roof, since the netting must be attached around its periphery to the edges of the roof structure. Thus, workers are required to climb the building structure or be lifted to each attachment point to secure the netting.

For roof structures which are built using the carriage as described above, it has been known to provide a platform which extends from the carriage in a direction towards the completed section of the roof, such as that disclosed in U.S. Pat. No. 5,664,740 to Alderman et al. The platform extends underneath the top portions of the purlins and supports the support sheet as the support sheet is loosely draped between adjacent purlins. The platform can be built of sufficient strength so as to support a worker stepping or falling onto the platform. However, the roof structures often include purlin support bracing and straps which extend between adjacent purlins. To accommodate the bracing, the platform is positioned near the top of the purlins so that the platform will not be obstructed by the bracing as the carriage moves. Thus, the support sheet is relatively flat across the tops of the purlins and does not hang down into the space between the purlins. Insulation material placed on top of the support sheet is then compressed when the hard roofing material is attached to the purlins.

It would be desirable to have a system of building roof structures which is simple and less time consuming to use, and which provides adequate protection from falling objects and for the workers constructing the roof.

SUMMARY OF THE INVENTION

The above objects as well as other objects not specifically enumerated are achieved by a method of building an insulated roof structure with the aid of a movable safety barrier which is moved along the length of purlins as the insulated roof structure is constructed.

The present invention provides for an apparatus for building a roof structure of the type having a plurality of purlins spaced apart from one another in a parallel arrangement and a method of using the same. The apparatus is a safety barrier which is mounted for movement along the length of the purlins. The barrier extends in a lateral direction across a plurality of the purlins. The barrier includes a plurality of runner portions positioned above the purlins. The barrier further includes a plurality of support portions extending between adjacent runner portions.

According to the present invention, there is also a method for providing a roof structure having a plurality of purlins spaced apart from one another in a parallel arrangement, wherein the purlins have top portions. A carriage is provided upon which is mounted a roll of support sheet, wherein the support sheet has side edges which are generally aligned with the top portions of adjacent purlins so that the support sheet can depend from the adjacent purlins. A barrier is also provided which extends laterally across the purlins. The barrier includes a plurality of runner portions positioned above the top portions of the purlins. The barrier further includes a plurality of support portions extending between adjacent runner portions. A first section of the roof structure, including deck sheets, is completed and fastened to the purlins. The barrier is positioned adjacent the completed section of the roof structure such that there is substantially no gap between the barrier and the completed section of the roof structure. A longitudinal edge of a deck sheet is then positioned over the barrier and over a longitudinal edge of another deck sheet which forms the completed section of the roof structure so that there is substantially no gap between the two deck sheets. The barrier is then moved along the length of the purlins in a direction away from the completed section of the roof structure. Thus, the roof structure can be constructed by repeating the above steps so that the barrier provides a movable barrier which is in front of the edge of the completed roof structure for the safety of the workers on top of the roof and below the roof.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
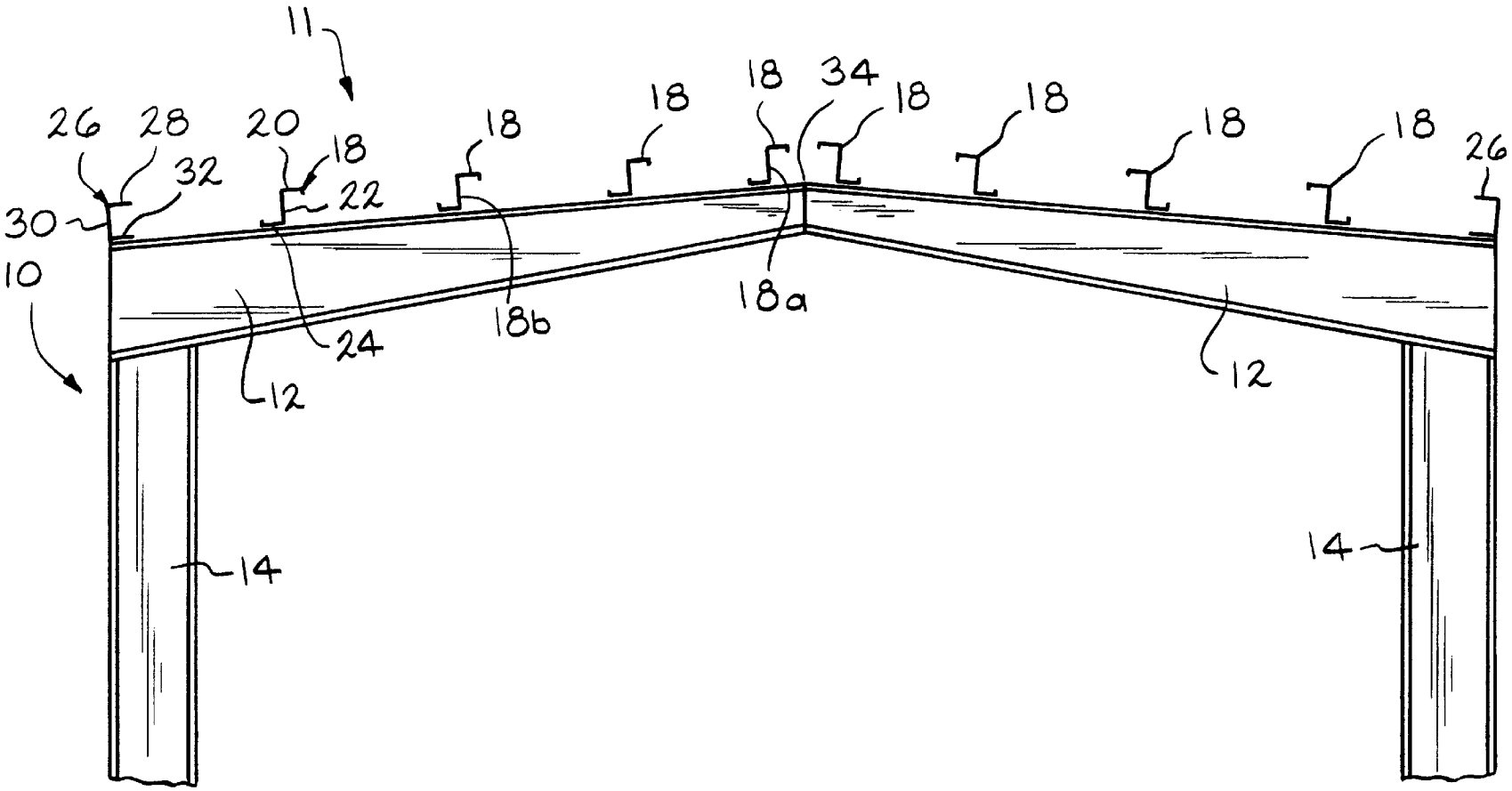
FIG. 1 is a schematic end view of a building incorporating a roof structure having a plurality of purlins supported by rafter beams.

Referring to FIG. 1, there is illustrated a building structure, indicated generally at 10, having a roof structure, indicated generally at 11. The roof structure is supported by a building framework which includes main rafter beams 12 positioned parallel to each other and supported by vertical column beams 14 extending upward from a floor (not shown). A plurality of purlins 18, spaced apart and arranged parallel to each other, is fastened on top of the rafters in a direction normal to the rafters. The purlins typically have a generally Z-shaped cross-section, and include a horizontally extending upper portion 20, a vertically extending web 22, and a horizontally extending lower portion 24. Roof structures may also be constructed from bar joists or trusses, and the invention as described herein will work equally well with purlins, bar joists or trusses. The use of the term "purlins" in this specification and claims includes not only traditional purlins, but also joists, trusses, and other similar structural members. Typically, the side of the roof structure has an eave strut 26 fastened to the rafters and extending parallel to the purlins. The eave struts typically have C-shaped cross-section and include a horizontally extending upper portion 28, a vertically extending web 30, and a horizontally extending lower portion 32. The building framework may have two sloped roof sides which are joined together to form a peak 34. Thus, the framework has successive adjacent purlins which are positioned lower than the peak as their distance from the peak increases. The sloped roof sides generally provide for rain and snow drainage. The spacing of the purlins is typically 5 feet (1.52 m) on centers.

Figure 2:
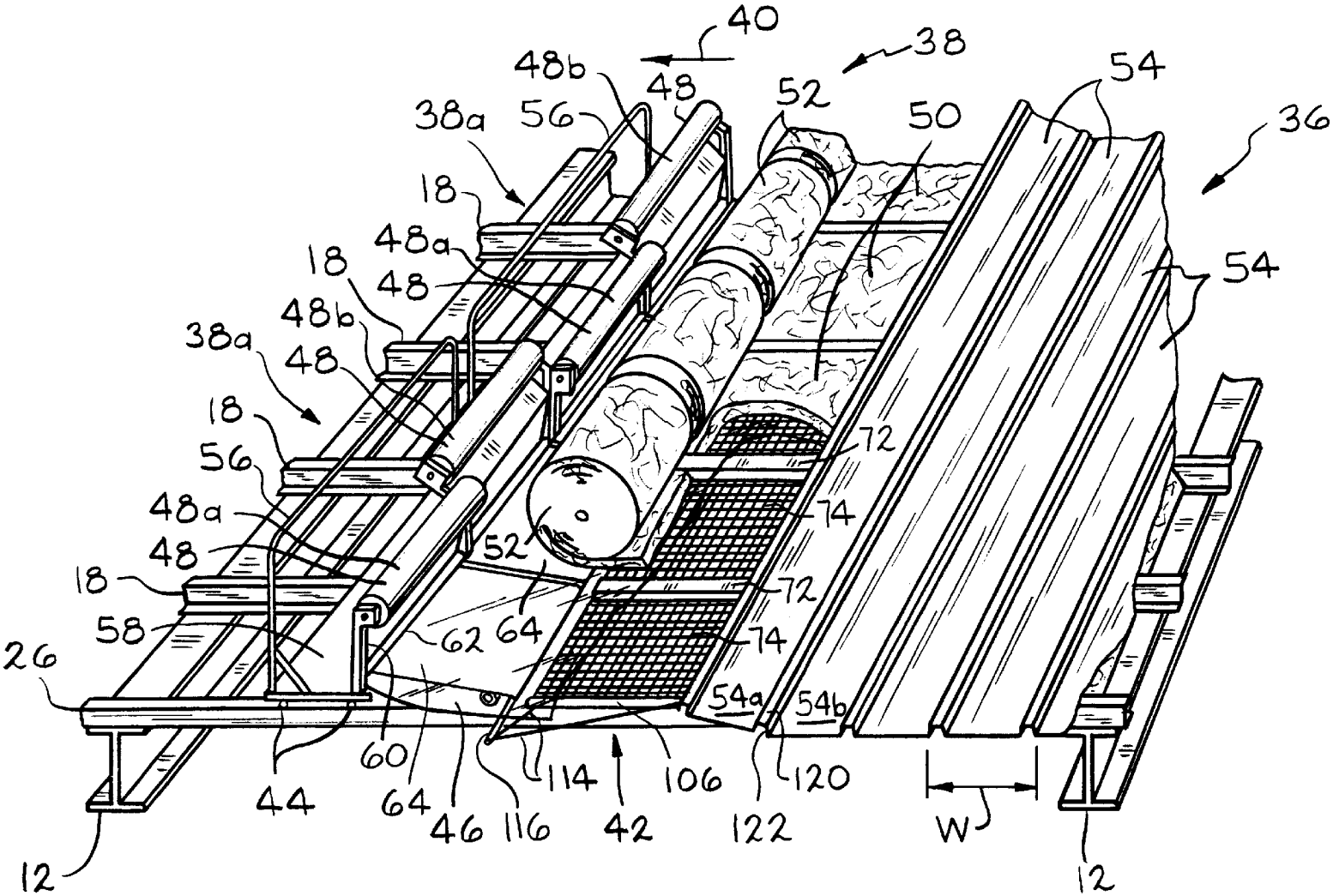
FIG. 2 is a perspective view of a carriage and a first embodiment of a barrier, in accordance with the present invention, positioned on top of the roof structure of FIG. 1.

The building structure 10 can incorporate various insulated roof structures, such as the insulated roof structure 36 illustrated in FIG. 2. Broadly stated, the roof structure is constructed by use of a carriage 38 which rides on the upper portion 20 of the purlins and travels along the length of the purlins in a downstream direction, represented by an arrow 40. The roof structure 36 is constructed with the aid of a first embodiment of a movable safety barrier, indicated generally at 42, in accordance with the present invention. As will be described in detail below, the barrier 42 provides fall protection for the workers working on top of the roof and from objects falling in the area between the carriage 38 and the completed section of roof structure.

Preferably, the carriage 38 has rollers 44 rotatably mounted on the carriage to roll along the upper portions of the purlins. As the carriage is moved, a support sheet 46 is payed out from a roll 48. For clarity, the support sheet is illustrated as transparent material, as shown in FIG. 2. The support sheet is draped on top of adjacent purlins so that the support sheet depends from the upper portion of the purlins. The support sheet supports a layer of insulation material 50 which is placed on top of the support sheet between the adjacent purlins. The insulation material is typically dispensed from a roll 52 but can be applied by any suitable manner, such as by applying insulation batts on top of the support sheet. Alternatively, a layer of insulation may be placed laterally across the purlins. After the insulation material has been placed on the support sheet, long sheets of hard roofing material, such as metal deck sheets 54 are then attached to the upper portion of the purlins over the support sheet and insulation. The deck sheets can be fastened to the purlins in any suitable manner, such as by threaded fasteners or clips. The attachment of the deck sheets presses down on the edges of the support sheet which are sandwiched between the upper portion 20 of the purlins and the deck sheets, so that the support sheet supports the insulation between the purlins.

Because the deck sheets are provided in relatively long lengths, typically 30 to 35 feet (9.1 to 10.7 m), and the roofs generally have two sloped roof sides, it is customary to construct a first section of the roof structure along the width of the sloped roof side and then proceed along the length of the structure from one end to the other. The workers stand on the previously attached first section of the roof structure to assemble the next section of roof. The carriage travels along the length of the purlins and is moved by the workers as each new section of roof is assembled.

The carriage can be any length up to the width of the roof itself. As shown in FIG. 2, the carriage is comprised of a plurality of carriage sections 38*a* which can be joined together so that they span the entire width of the sloped section of the roof. The carriage is then propelled across the purlins by pulling means, such as winches (not shown), in the downstream direction 40 so that all the carriage sections move in unison. Because the support sheet is draped across the upper portion of adjacent purlins, the total width of the support sheet is wider than the distance between the purlins.

Therefore, adjacent support sheet rolls are not co-linear and must be slightly staggered. Typically, a carriage section 38*a* covers two purlin spans, i.e., about 10 feet (3.3 m) in length. Therefore, each carriage section preferably has both a leading roll 48*a* and a trailing roll 48*b* of insulation support sheet, one roll for each of two adjacent purlin spans. The edge of the support sheet from the trailing roll 48*b* will be draped on top of the edge of the support sheet from the leading roll 48*a* as the carriage moves in the downstream direction. Multiple identical carriage sections 38*a* having a leading is and trailing roll can, therefore, be joined together, with every roll being staggered from an adjacent roll.

The carriage 38 can be any suitable apparatus which moves along the top of the purlins and dispenses the support sheet. As seen from FIG. 2, the carriage preferably includes safety handrails 56 and a deck 58 for the worker to stand on while operating or moving the carriage. The rollers 44 are mounted from the deck 58 of the carriage. The carriage also includes a framework 60 for mounting the rolls 42 and 50. Mounted on the framework are turning bars 62 which extend laterally across associated support sheets and are positioned slightly above the upper portions 20 of the purlins 18 so as to direct the support sheet to a generally horizontal position. Preferably, the carriage also includes a plurality of guides (not shown) which extend downwardly from the deck 54 and prevent the carriage from moving in a lateral direction with respect to the purlins. The guides help the carriage travel accurately along the length of the purlins so that the longitudinal edges of the support sheet are dispensed evenly across the respective upper portions of the purlins. Attached to the carriage are optional plates 64 which extend from the carriage in an upstream direction opposite the downstream direction 40. The plates support the rolls 52 of insulation. Preferably, the plates are sufficiently built so that the plate can be used for fall protection for the workers to prevent them from falling off of the roof structure. As used in this specification and claims, the term "fall protection" means that the structure built for fall protection will withstand a static load of 400 lbs. This should be adequate to support a worker falling onto the structure. The plate can be attached to the carriage by any suitable means. The plate follows the carriage as the carriage moves along the length of the purlins.

The space between the vertical webs 22 of adjacent purlins 18 defines an insulation cavity having a generally rectangular cross-sectional shape. It is advantageous to fill out the insulation cavity uniformly with the insulation material without leaving relatively large gaps, thereby maximizing the insulating qualities of the roof structure. The purpose of the support sheet is to support the insulation material in the insulation cavity, but the support sheet can also be used as a vapor barrier, and for aesthetic purposes. The support sheet can be of any suitable material for the stated purposes, such as vinyl or foil faced paper.

As shown in FIG. 2, the barrier 42 extends laterally across a plurality of purlins and is positioned between the carriage 38 and a completed section of the roof structure 36. The completed section of the roof structure includes the support sheets 46 draped between adjacent purlins, insulation material 50 placed above the support sheets, and the deck sheets 54 fastened to the top portions 20 of the purlins. The illustrated embodiment of the barrier 42 generally includes a plurality of runner portions, such as runners 72, and a plurality of support portions, such as netting 74, which are attached to the runners. The support portions can be any suitable non-rigid material, such as mesh, webbing, lattice, canvas, or fabric which provide fall protection to support a worker falling onto the support barrier. Alternatively, the support portions can be rigid structural members. Preferably, the support portions are also able to catch falling objects, such as various tools and fasteners which are dropped from above the barrier to protect the workers below the roof structure. The runners are positioned above the purlins 18 and are adapted to move along the top portions 20 of the purlins. The netting extends between adjacent runners and is positioned so that the support sheet is above the netting as the support sheet is dispensed.

Figure 3:
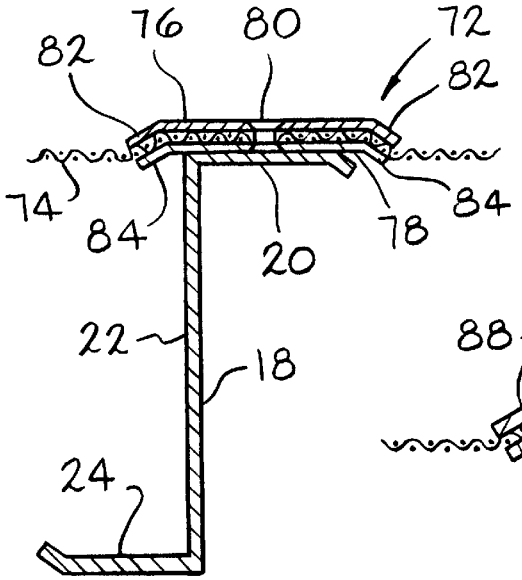
FIG. 3 is a sectional view of the runner of the barrier illustrated in FIG. 2 shown positioned on top of a purlin.

The runners 72 can be any suitable structure which is capable of traveling over the purlins when the barrier is moved along the length of the purlins, the reason for which will be explained below. There is shown in FIG. 3, a first embodiment of the runner 72. The runner includes an upper plate 76 and a lower plate 78 which are fastened together by a suitable fastener, such as a rivet 80. The netting 74 is sandwiched between the upper and lower plate to attach the runner to the netting. Thus, a single length of netting having a plurality of runners fastened along the length can be used to form a plurality of support portions. The lower plate 78 slides along the top portions 20 of the purlin. Preferably, the upper and lower plates have edge portions 82 and 84, respectively, which are angled downward at an obtuse angled with respect to the main portion of the plates. The edge portions help to prevent the runner from moving in a lateral direction with respect to the top portion of the purlins, thereby keeping the runner in alignment as the barrier moves along the length of the purlins. If desired, the runner may have a ramped end (not shown) to assist the runner in moving over obstructions encountered as the barrier moves along the length of the purlins, such as bolts or purlin joint connection.

Figure 4:
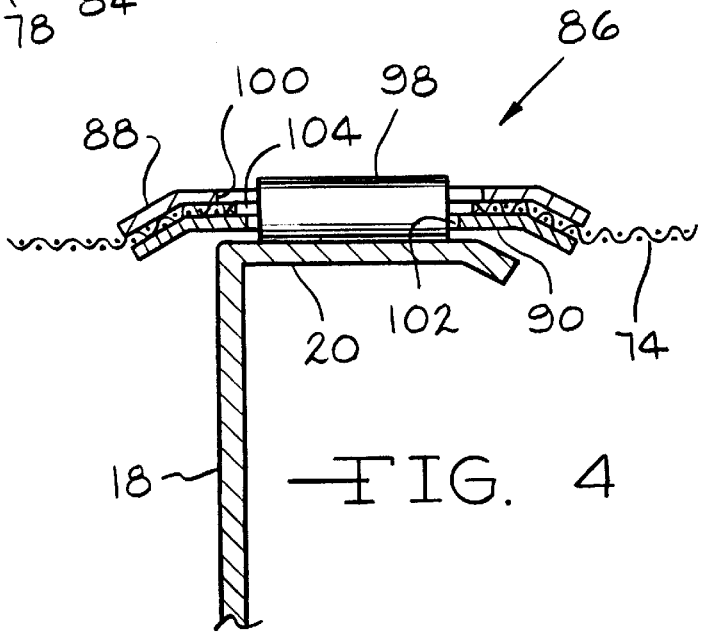
FIG. 4 is a cross-sectional view of an alternate embodiment of a runner, in accordance with the present invention.

There is shown in FIG. 4 a second embodiment of a runner 86 having an upper plate 88 and a lower plate 90 fastened together. The runner 86 further includes a roller 98 which extends through slots 100 and 102 formed through the upper and lower plates, respectively. The roller can be mounted on the runner by any suitable means, such as by welding an axle 104 to the lower plate 90. The roller rolls along the top portions 20 of a purlin to provide ease of motion for the runner as the barrier travels along the length of the purlins.

Figure 5:
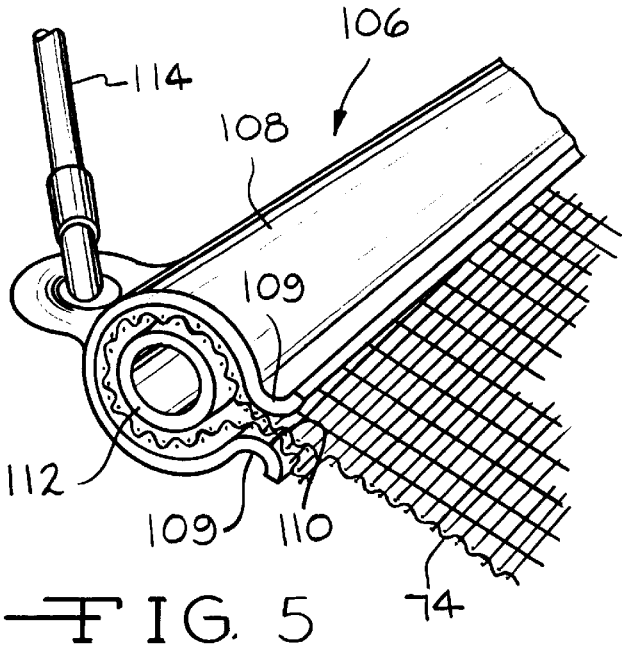
FIG. 5 is a perspective view of an end support of the barrier illustrated in FIG. 2.

The barrier 42 can be attached to the carriage 38 for movement therewith or can be unattached and moved separately from the carriage. The barrier can be attached to the carriage by any suitable method. As shown in FIGS. 2 and 5, the lateral side edge of the netting 74 is adjustably fastened to an end support 106. The end support 106 includes an outer tube 108. The outer tube has a pair of curved flanges 109 defining a longitudinal opening 110 formed through the outer tube. The end of the netting is inserted through opening 110 and looped around a rod 112 disposed in the outer tube 108 so that another portion of the netting extends through the opening. The netting, the rod, and the outer tube cooperate to provide an adjustable attachment mechanism for the end of the netting. When the netting is pulled in a direction away from the opening 110, the rod advances towards the opening 110 of the outer tube so that the frictional engagement between the rod, the netting, and the outer tube causes the rod to wedge between the curved flanges 109, thereby preventing the netting from being pulled out farther. Thus, the end of the netting is secured in the outer tube. To adjust the attachment point of the netting in the outer tube, the netting is pushed or forced in the opening, thereby releasing the wedging action of the rod so that the netting can be repositioned with respect to the rod.

The end support is attached to the carriage by a cable 114 fastened to a pole 116 extending from one of the plates 64, as shown in FIG. 2.

To construct the roof structure with the aid of the barrier 42, a section of the roof structure 36 is first completed such that the deck sheet is fastened to the purlins by fasteners or clips (not shown). The barrier 42 is then preferably positioned between the carriage 38 and the completed section of the roof structure 36 such that there is substantially no gap between the barrier and the completed section of the roof structure, and there is substantially no gap between the barrier and the end of the carriage, such as the plates 64. Thus, the barrier generally covers the gap between the completed section of the roof structure 36, and the carriage. The term "substantially no gap" as used in the specification and the claims, is defined as having a gap between two structural members which is no greater than several inches. The barrier 42 provides for fall protection for the workers on top of the roof structure. As the roof structure is constructed, the workers are standing on the previously completed section of the roof structure and without fall protection would be in danger of falling while pushing the carriage or handling the roof structures, especially on windy days. Previously, the workers had to be tied off with ropes to prevent them from falling over the edge of the roof structure. These ropes and tie lines are cumbersome and can entangle in the sheets of insulation or deck sheets.

Referring to FIG. 2, a deck sheet 54*a* is then placed on the completed section of the roof structure 36 such that a longitudinal edge 120 of the deck sheet 54*a* is loosely hooked to a longitudinal edge 122 of a previously fastened deck sheet 54*b*. Note that the deck sheet 54*a* is also positioned above the barrier 42. The carriage 38 and the barrier 42 are then moved in the downstream direction 40 along the length of the purlins. As the carriage moves, the support sheets 64 and the insulation material 50 are dispensed from the rolls 48 and 52, respectively. The carriage and the barrier are then moved in the downstream direction 40. The carriage and the barrier can be moved a distance which is less than the width W of the deck sheets so that a portion of the deck sheet 54*a* is still above the barrier so that there is substantially no gap between the deck sheet 54*a* and the barrier 42. If the deck sheets are fastened to the purlins by clips (not shown), the barrier can be moved away from the downstream edge of the deck sheet 54*a* to allow room for attachment of the clips to the purlins prior to the fastening of the deck sheets. The deck sheet 54*a* can then be fastened to the top portions of the purlins. The steps of moving the carriage and the barrier, and fastening the deck sheets are then repeated to complete the construction of the roof structure.

The carriage and the barrier preferably extend the entire width of the roof structure 11, generally from the eave strut 26 to a purlin 18*a* adjacent the peak 34 of the roof, as shown in FIG. 1. Thus, the entire sloped section of the roof can be built. However, it should be understood that the barrier or the carriage can be extended between any multiple numbers of purlins. For example, the carriage and the barrier could extend from the purlin 18*a* to a purlin 18*b*, or any other desired purlin. Also, the barrier and the carriage can have different widths. For example, a plurality of barriers can be used to span the width of the carriage. Although it is preferred that the barrier be attached to the carriage, the barrier could be unattached from and moved separately from the carriage, such as by push rods (not shown) for pushing against the runners.

Preferably, the netting is draped between the purlins so that the netting extends into the insulation cavity between the vertical webs 22 of adjacent purlins. This enables the support sheet 46, which is above the barrier 42, to depend from the top portions of the purlins to create space for insulation material 50 placed above the support sheet. If the support sheet is allowed to drape from the purlins by a sufficient amount, the insulation material is not compressed when the deck sheets are fastened to the purlins.

Figure 6:
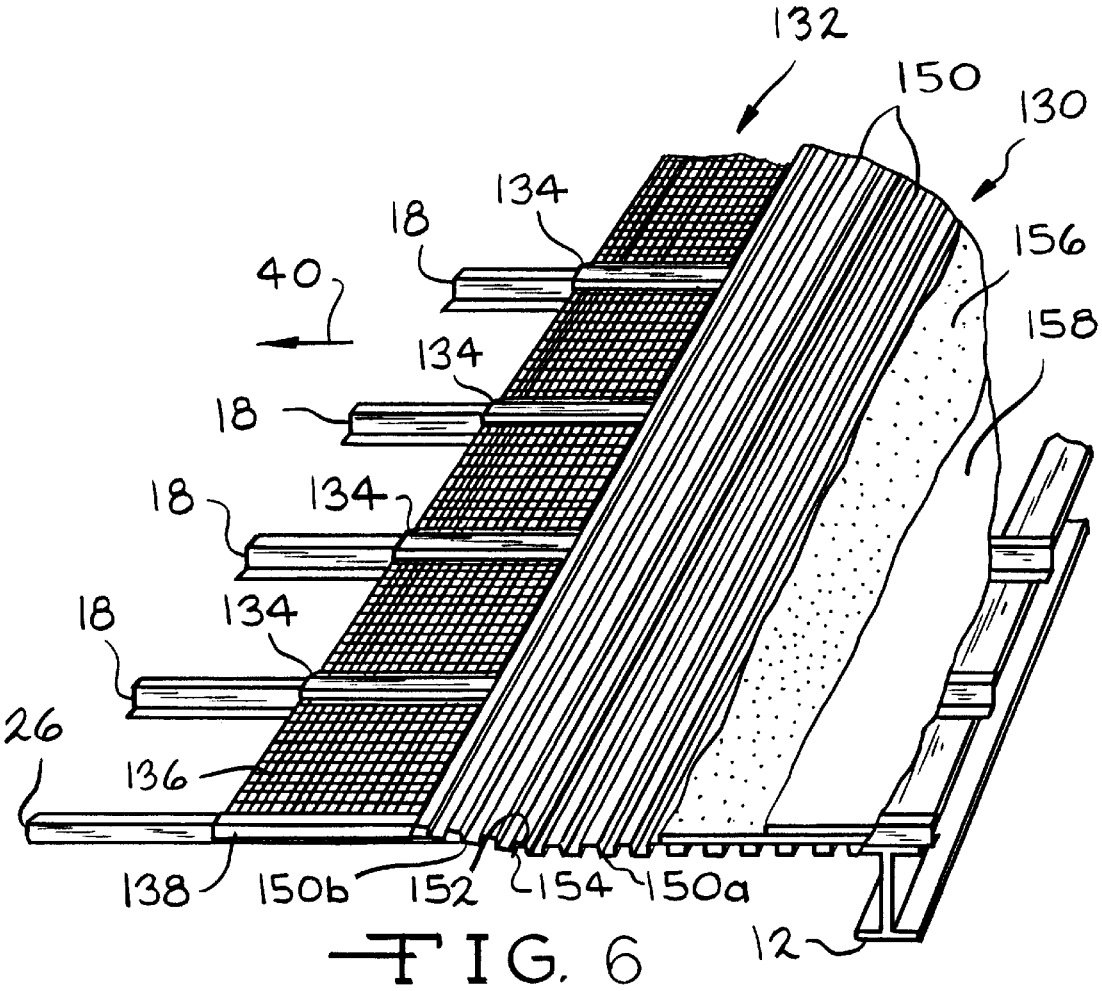
FIG. 6 is a perspective view of a second embodiment of a barrier, in accordance with the present invention, being used to construct a second type of roof structure.
Figure 7:
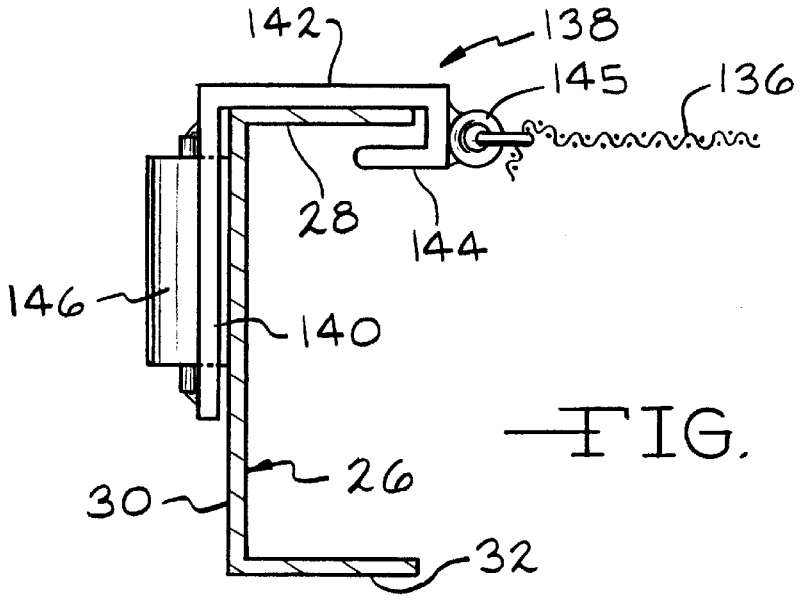
FIG. 7 is an end view of an end support of the barrier illustrated in FIG. 6, wherein the end support is mounted on an eave strut.

There is illustrated in FIG. 6 and 7 a second type of an insulated roof structure, indicated generally at 130, which is constructed with the aid of a second embodiment of a barrier 132. The barrier 132 is similar to the barrier 42 in that the barrier 132 includes runners 134 and netting 136. However, the side edges of the barrier 132 are moveably fastened to an eave strut or a purlin by an end support 138. The end support 138 can be any suitable structure which fastens the side edge of the barrier 132 to an eave strut or purlin so that the barrier 132 is restricted from moving in a lateral direction with respect to the purlins, while permitting the barrier to move along the length of the purlins in the downstream direction 40.

There is illustrated in FIG. 7, an embodiment of the end support 138 which is moveably mounted on the eave strut 26. The end support 134 includes a vertical portion 140, a horizontal portion 142, and a hook portion 144 which can be formed from a single plate. The end of the netting 136 is attached to the hook portion of the end support in any suitable manner, such as by tying the edge of the netting to eyelets 145 attached to the hook portions. The end support 138 generally surrounds the upper portion of the eave strut so as to restrict lateral movement of the end support 138 with respect to the eave strut 26. Rotatably mounted on the vertical portion 142 is a roller 146 for a rolling engagement between the end support and the vertical web 30 of the eave strut.

To construct the roof structure 130, deck sheets 150 are suitably fastened to the top portions of the purlins. The barrier 132 is positioned adjacent the deck sheet which is farthest in the downstream direction, such as deck sheet 150*a*. Preferably, the barrier 132 is positioned so that there is substantially no gap between the barrier 132 and the deck sheet. A deck sheet 150*b* is then placed on the deck sheet 150*a* and above the barrier 132 so that a longitudinal edge 152 of the deck sheet 150*b* is positioned or hooked above a longitudinal edge 154 of the deck sheet 150*a*. Thus, there is substantially no gap between the deck sheets 50*a* and 150*b*. The barrier 132 is then preferably moved by a distance which is less then the width of the deck sheets 150 so that the barrier 132 remains adjacent the deck sheets 150, and so that there is substantially no gap between the barrier and the completed section of the roof structure. This provides continuous fall protection for the workers standing on the roof structure 130. Another deck sheet (not shown) is then placed in the same manner as described above and the preceding deck sheet is fastened to the purlins. However, the barrier can be moved out from underneath the deck sheet so that the deck sheet can be fastened to the purlins. The roof structure 130 includes insulation material, such as rigid foam board 156, placed on top of the deck sheets 150. The foam board can be fastened to the deck sheets by the same fasteners (not shown) which attach the deck sheets to the purlins. A weather proof membrane 158 is then applied on top of the foam board 156 to provide a weather tight seal for the roof structure 130.

Figure 8:
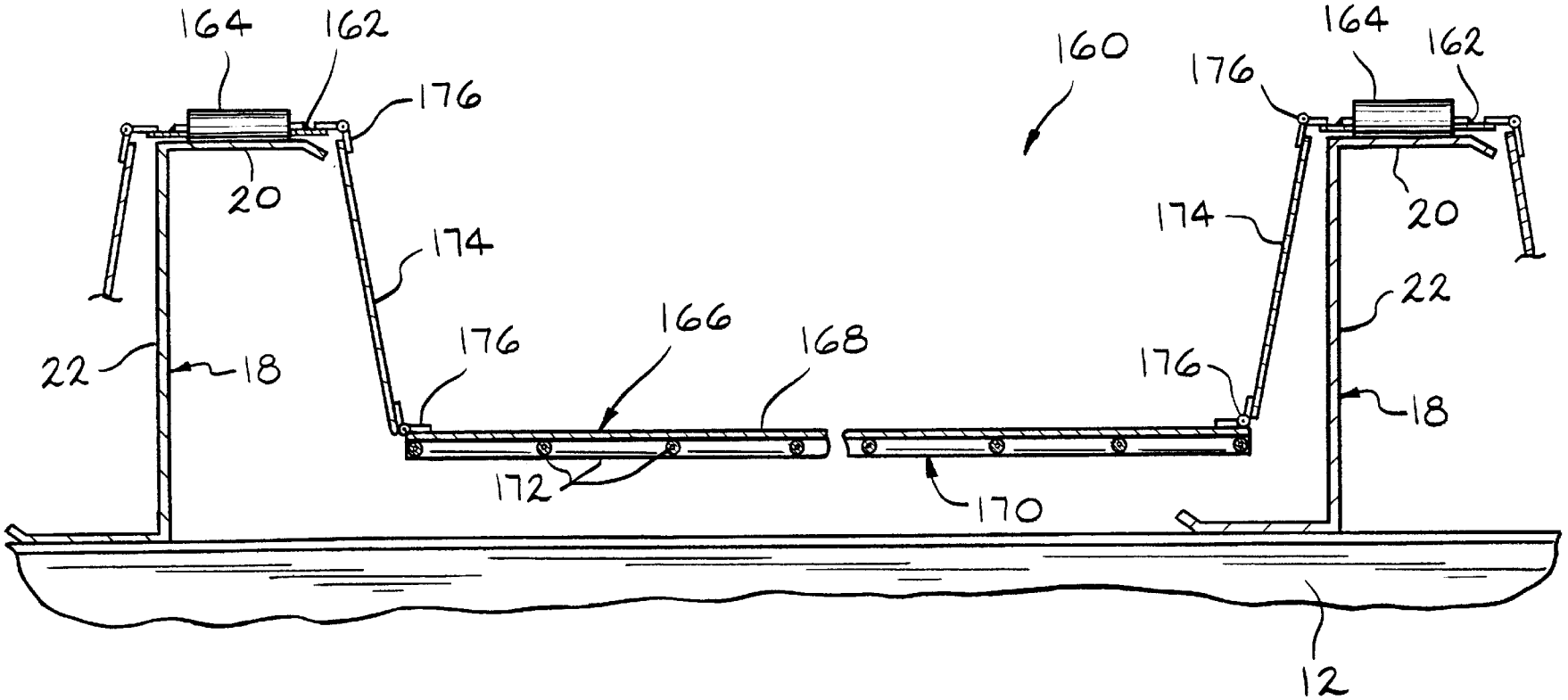
FIG. 8 is a cross-sectional view of a third embodiment of a barrier, in accordance with the present invention.

There is illustrated in FIG. 8, a third embodiment of a barrier, indicated generally at 160. The barrier 160 includes a plurality of runners 162 having rollers 164 for rolling along the top portions 20 of the purlins 18. The barrier further includes support portions having rigid panels 166. The rigid panels 166 can include a planar metal sheet 168 which is supported by a rigid grid framework 170 formed of tubular bars 172 to provide structural strength to the rigid panel. The rigid panels are attached to the runners by straps 174 which are pivotally mounted on the runners and the rigid panels by hinges 176. The hinges 176 provide limited lateral movement of the rigid panels with respect to the runners to accommodate uneven purlin spacing. If the barrier 160 is used with the carriage 38 of FIG. 2, the barrier can help form the cross-sectional shape of the support sheet as it is laid down so that it conforms to the generally rectangular shape of the insulation cavity defined between the vertical web portions 22 of adjacent purlins.

The principle and mode of operation of this invention have been described in its preferred embodiments. However, it should be noted that this invention may be practiced otherwise than as specifically illustrated and described without departing from its scope.

What is claimed is:

1. A barrier movable along a roof structure having purlins spaced apart from one another in a parallel arrangement, the barrier extending laterally across a plurality of the purlins, the barrier comprising:

a plurality of runner portions positioned above the purlins; and a plurality of support portions extending between adjacent runner portions, wherein the support portions are formed of a non-rigid material and have end portions which define the ends of the barrier, and wherein the end supports include:

an outer tube having a longitudinal opening formed therein; and a rod disposed within the outer tube, the end portions of the support portion being extended through the longitudinal opening and looped around the rod to secure the support portion to the end portion.

2. The barrier of claim 1, wherein each runner portion includes a rigid plate which slides along top portions of the purlins as the barrier moves along the length of the purlins.

3. The barrier of claim 1, wherein each runner portion includes a roller for rolling along top portions of the purlins as the barrier moves along the length of the purlins.

4. The barrier of claim 1, wherein the barrier is sufficient for fall protection.

5. The barrier of claim 1, wherein the support portions include netting.

6. The barrier of claim 1, wherein the support portions include netting, and the runner portions include pairs of rigid plates which slide along top portions of the purlins as the barrier moves along the length of the purlins, and wherein the netting is disposed between the pairs of plates to fasten the netting to the plates.

7. In combination:

1) a roof structure having a plurality of elongated purlins spaced apart from one another in a parallel arrangement, the roof structure having first and second purlins defining ends of the roof structure; and 2) a barrier extending laterally across the plurality of purlins, the barrier being movable along the length of the plurality of purlins, the barrier comprising:

a plurality of runner portions positioned above the plurality of purlins;

a plurality of support portions extending between adjacent runner portions, wherein the support portions are formed of a non-rigid material; and a pair of end supports fastened to ends of the barrier, the pair of end supports being moveably fastened to the first and second purlins, respectively, thereby prohibiting the ends of the barrier from moving in a direction lateral to the length of the purlins, while permitting the barrier to move in a direction along the length of the purlins, the pair of end supports including an outer tube having a longitudinal opening formed therein; and a rod disposed within the outer tube, the end portions of the support portion being extended through the longitudinal opening and looped around the rod to secure the support portion to the end portion.

8. The combination of claim 7, wherein the first and second purlins have a generally vertical web portion and a generally horizontal portion extending from a top portion of the vertical web portion, and wherein the end supports conform to the shape of the first and second purlins, thereby prohibiting the ends of the barrier from moving in a direction lateral to the length of the purlins, while permitting the barrier to move in a direction along the length of the purlins.

9. The combination of claim 8, wherein the vertical portion of the end support includes a roller in rolling engagement with the vertical web portion of the respective first or second purlin.

10. The combination of claim 7, wherein the support portions include netting.

11. The combination of claim 7, wherein the runner portions include a rigid plate which slides along top portions of the purlins as the barrier moves along the length of the purlins.

12. The combination of claim 7, wherein the runner portions include rollers for rolling along top portions of the purlins as the barrier moves along the length of the purlins.

13. A barrier movable along a roof structure having purlins spaced apart from one another in a parallel arrangement, the barrier extending laterally across a plurality of the purlins, the barrier comprising:

a plurality of runner portions positioned above the purlins; and a plurality of support portions extending between adjacent runner portions, wherein the support portions are formed of a non-rigid material and have end portions which define the ends of the barrier, and wherein the end supports include:

a horizontal portion positioned above a respective horizontal portion of the first or second purlin;

a vertical portion positioned adjacent a vertical web portion of the respective horizontal portion of the first or second purlin; and a hook portion extending from the horizontal portion of the end support and positioned underneath the horizontal portion of the respective first or second purlin.

14. In combination:

1) a roof structure having a plurality of elongated purlins spaced apart from one another in a parallel arrangement, the roof structure having first and second purlins defining ends of the roof structure; and 2) a barrier extending laterally across the plurality of purlins, the barrier being movable along the length of the plurality of purlins, the barrier comprising:

a plurality of runner portions positioned above the plurality of purlins;

a plurality of support portions extending between adjacent runner portions, wherein the support portions are formed of a non-rigid material; and a pair of end supports fastened to ends of a barrier, the pair of end supports being moveably fastened to the first and second purlins, respectively, thereby prohibiting the ends of the barrier from moving in a direction lateral to the length of the purlins, while permitting the barrier to move in a direction along the length of the purlins, the pair of end supports including a horizontal portion positioned above a respective horizontal portion of the first or second purlin, a vertical portion positioned adjacent the vertical web portion of the respective horizontal portion of the first or second purlin, and a hook portion extending from the horizontal portion of the end support and positioned underneath the horizontal portion of the respective first or second purlin.

* * * * *